United States Patent [19]

Johnson

[11] 3,934,928

[45] Jan. 27, 1976

[54] ADJUSTABLE OPERATORY CHAIR

[75] Inventor: Philip C. Johnson, Cincinnati, Ohio

[73] Assignee: Dentsply Research & Development Corporation, Milford, Del.

[22] Filed: Dec. 27, 1973

[21] Appl. No.: 428,950

[52] U.S. Cl. ..... 297/71; 297/330

[51] Int. Cl.[2] ..... A61G 15/00

[58] Field of Search ..... 297/330, 71, 346; 248/419, 248/420, 429

[56] References Cited

UNITED STATES PATENTS

| | | | |
|---|---|---|---|
| 2,982,335 | 5/1961 | Garvey | 248/419 |
| 2,983,545 | 5/1961 | Garvey | 297/346 X |
| 3,072,231 | 1/1963 | Iding | 248/419 X |
| 3,105,670 | 10/1963 | Pickles | 297/346 X |
| 3,115,328 | 12/1963 | Brown | 248/429 |
| 3,220,762 | 11/1965 | Garvey | 248/419 X |
| 3,223,377 | 12/1965 | Robbins | 248/419 |
| 3,381,997 | 5/1968 | Fritz | 297/330 X |
| 3,804,460 | 4/1974 | Leffler | 297/71 X |

*Primary Examiner*—Francis K. Zugel
*Attorney, Agent, or Firm*—Jerry W. Berkstresser; C. Hercus Just

[57] ABSTRACT

An operatory-type chair having a seat to which a back rest is pivotably connected for movement between upright and rearwardly extending positions by an electric motor interconnected to said back rest by a rotatable screw driven by said motor. Movement of the back rest is controlled by limit switches which stop the motor when either limit of movement is reached, the invention comprising an adjustable program switch included in said control system which operates to stop the motor when the back rest reaches a desired position intermediately of the opposite limits of movement thereof, as controlled by said limit switches.

7 Claims, 10 Drawing Figures

ADJUSTABLE OPERATORY CHAIR

BACKGROUND OF THE INVENTION

The present invention pertains to a professional-type chair such as used by dentists, ophthalmologists, and other types of medical or quasi-medical professions in which adjustable operatory chairs are useful. Also, details and features of mechanisms found in such types of chairs are frequently employed in chairs used in barbering and beauty culture. One of the most common features now found in this type of chair comprises an upholstered seat to the rear edge of which a back rest is pivotally connected, and power means are employed to operate the back rest between substantially upright and rearwardly extending horizontal positions. Appropriate control means are employed to effect operation of one or more electric motors which effect movements of the back rest relative to the seat. In addition, many types of chairs of this type include a leg rest and/or a foot rest, the leg rest being pivotally connected to the seat adjacent the forward edge thereof and movement of the leg rest frequently occurs simultaneously with pivotal movement of the back rest relative to the seat.

Effecting control of the back rest and/or leg rest relative to the seat is accomplished in certain modern types of chairs of the type referred to above by means of rather sophisticated electrical circuitry, batteries of push buttons by which various switches are operated to start and stop the movements of the back and/or leg rests relative to the seat, as well as raising and lowering the seat with respect to a supporting base. Examples of such control in chairs of this type are found in various patents, including U.S. Pat. No. 3,357,740 to Vaughn et al, dated Dec. 12, 1967, and U.S. Pat. No. 3,578,379 to Taylor, dated May 11, 1971. Notwithstanding such sophisticated control systems, especially for moving the back and leg rests relative to a seat, as disclosed in said patents, it now has been found that in adjustable operatory chairs of the type referred to above, it is desirable to provide adjustable, programmable control means by which, for example, any adjustable setting may be effected quickly and manually by the operator of the chair to dispose the back rest and/or leg rest at a desired position intermediately between the limits of movement thereof, such as between substantially vertical position and horizontally extending position, with respect to both the back rest and/or leg rest.

SUMMARY OF THE INVENTION

It is the principal object of the present invention to provide a very simple, yet highly useful and effective adjustable, programmable control switch by which the motor of a power-operated operatory chair may be actuated and caused to stop at a desired location of the back rest and/or leg rest intermediately between the substantially vertical and horizontal limits of movement thereof.

It is another object of the invention to employ such adjustable, programmable control switch in relation to an actuator screw which is rotated by an electric motor mounted, for example, beneath the seat of the chair, the screw being associated with an appropriate nut, which is interconnected to the back rest, for example, in a non-rotatable manner relative to the screw.

It is a further object of the invention to combine such adjustable, programmable control switch preferably with limit switches which are adapted to stop operation of the motor when the opposite limits of movement of the back rest, for example, with respect to the seat, have been reached, whereby no injury to the chair elements or power means will result.

Still another object of the invention is to include gear reduction means between the electric motor and the actuator screw and also include speed-reduction means between the actuator screw and a shaft upon which cams are mounted for operating the limit switches, said shaft also adjustably supporting an additional actuator for the adjustable, programmable switch, whereby during a full excursion of movement of the back rest, for example, with respect to the seat between the opposite limits of movement of the back rest, said shaft upon which the switch actuating cams are mounted will rotate only approximately one full revolution.

Still another object of the invention is to provide an actuator for the adjustably operable programmable switch in the form of a manually engageable knob having a cam on one end thereof which operates the switch lever, said knob and cam being frictionally mounted on a readily accessible end of said shaft located preferably adjacent one side the seat of the chair, the friction of the connection being such that movement of the knob relative to the shaft easily may be effected, but said friction being sufficient to maintain the knob and cam at a desired location upon said shaft after an adjustable position thereon has been reached by the operator.

Details of the foregoing objects and of the invention, as well as other objects thereof, are set forth in the following specification and illustrated in the accompanying drawings comprising a part thereof.

DETAILED DESCRIPTION

For purposes of simplifying the following description and also for purposes of suitably illustrating the present invention, the illustration of a chair embodied in applicant's co-pending application, Ser. No. 288,185, filed Sept. 11, 1972, is employed in the present application and, as the basic structure, the first five figures of the instant application are the same as the corresponding first five figures of said copending application. Accordingly, a full description of all details of the chair illustrated in FIGS. 1 through 5 is curtailed herein, in comparison with description in said copending application, especially in view of the fact that the present invention is concerned primarily with movement controlling mechanism by which the back rest and leg rest of said chair are moved relative to the seat. Accordingly, for detailed description which is not found in the instant application, attention is directed to said co-pending application to provide the same.

Figure 1:
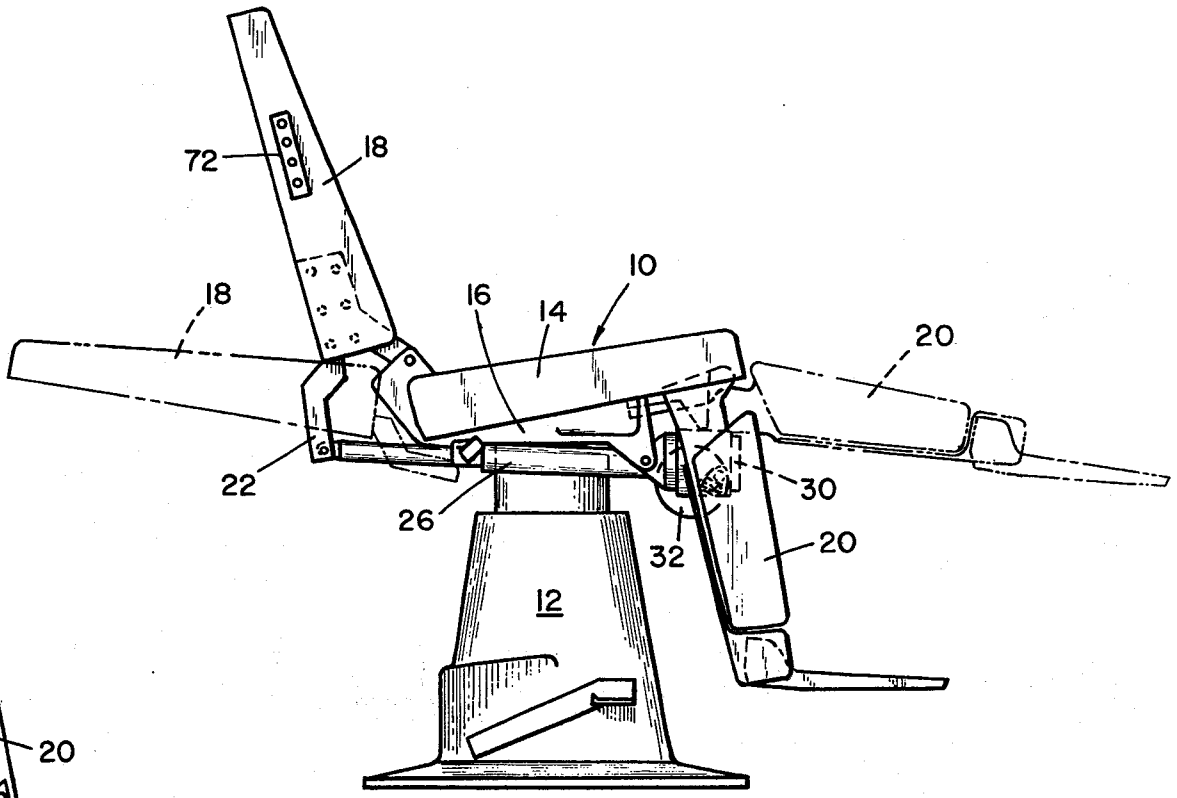
FIG. 1 is a side elevation of an exemplary power-operated chair embodying the principles of the present invention and in which the back rest and leg rest are illustrated in full lines in their substantially vertical position, while the same are illustrated in phantom in their extended, substantially horizontal position.
Figure 2:
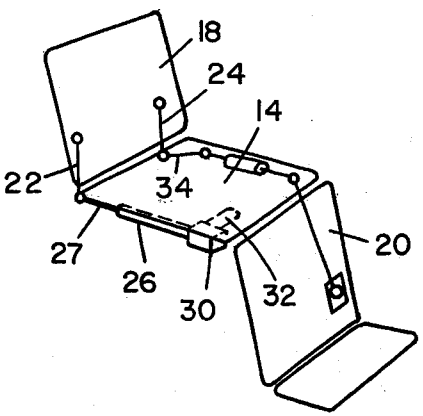
FIG. 2 is a diagrammatic illustration of the essential movable elements of the power-operated chair illustrated in FIG. 1.

Referring to the drawings, especially FIG. 1, it will be seen that the chair 10 to which the present invention pertains comprises a base 12 of any suitable type which supports the seat 14 by being connected to the frame structure 16 upon which the seat 14 rests. Pivotally connected to the seat 14 adjacent the rear edge thereof is a back rest 18. Similarly, adjacent the front edge of the seat 14, a leg rest 20 is pivotally connected. In accordance with the desired operations of chairs of the type to which the present invention pertains, such as those used in dental operatories, the practice of ophthalmology for examination and treatment of patients, barbers, and beauticians, as well as similar professions and occupations, it is desirable that the back rest 18 and also the leg rest 20, when the latter is included in the chair structure, shall be movable between substantially and respectively vertical and depending directions, and substantially horizontally extending directions respectively from the rear and forward edges of the seat 14.

Figure 3:
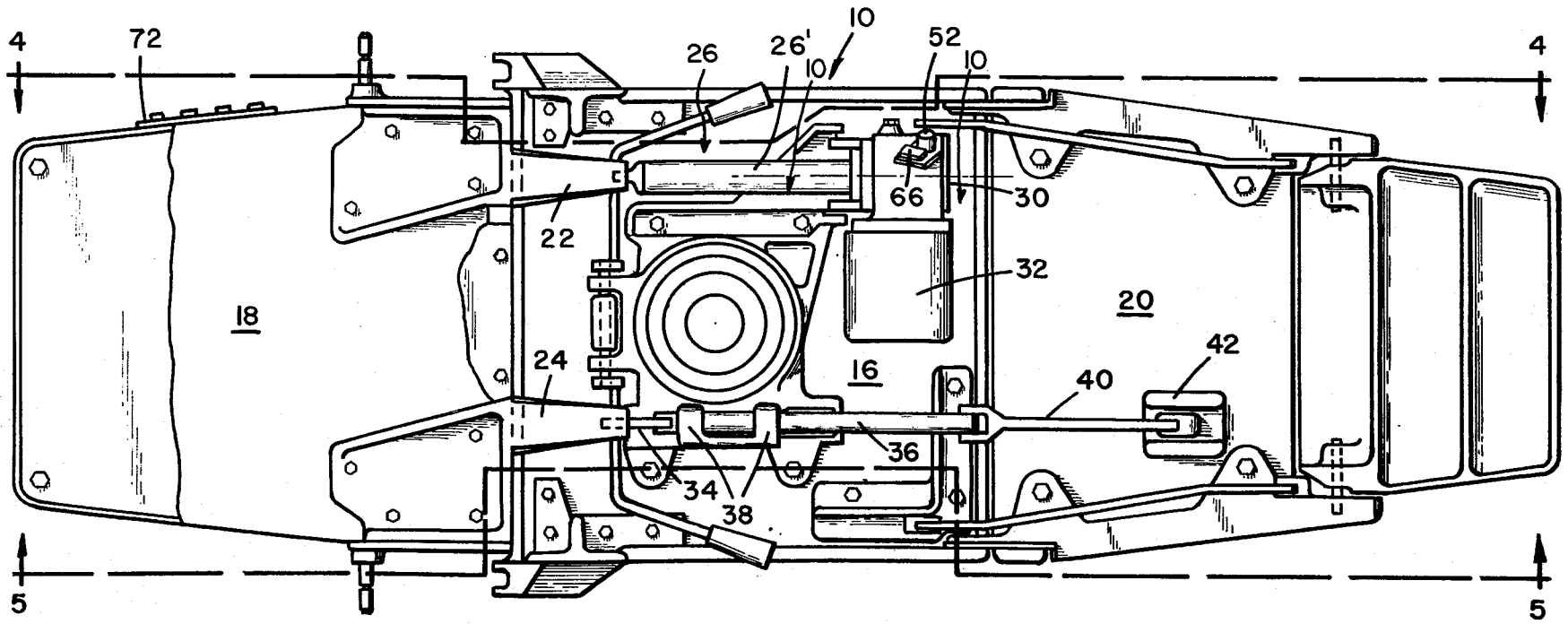
FIG. 3 is a bottom plan view of the power-operated chair shown in FIG. 1, and in which the back rest and leg rest are shown in extended, substantially horizontal positions with respect to the seat.
Figure 4:
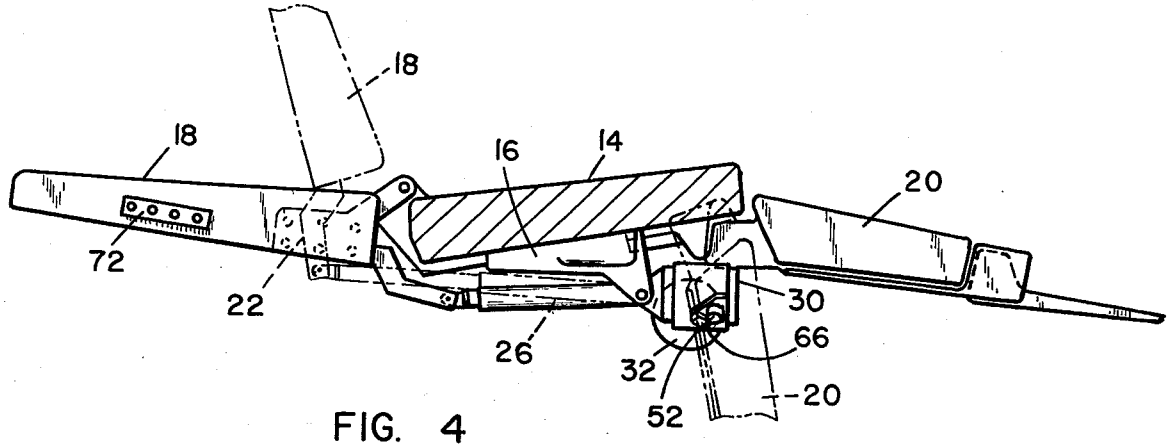
FIG. 4 is a side elevation arranged to illustrate details of the power means which include an electric motor and screw jack connected thereto and the outer end of the screw jack being pivotally connected to an extension on the back rest, substantially as seen on the line 4—4 of FIG. 3.
Figure 5:
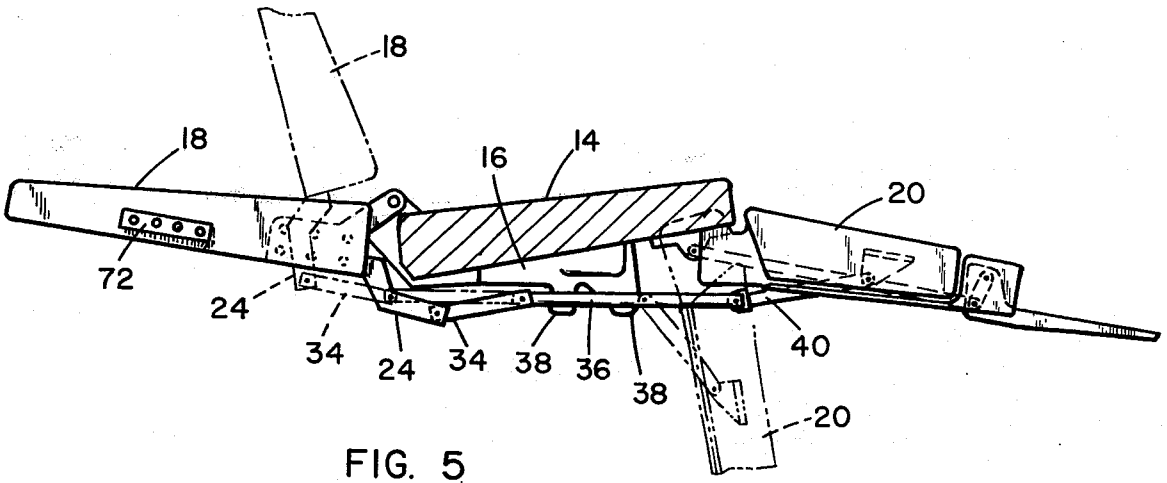
FIG. 5 is a view similar to FIG. 4, but being arranged to illustrate the linkage by which one of the extensions on the back rest is connected to the leg rest in order to transmit direct movement thereto resulting from pivotal movement of the back rest with respect to the seat, as seen on the line 5—5 of FIG. 3.

Appropriate mechanism for moving said back rest and seat rest between the limits of movement therefor illustrated respectively in full line and phantom manner in FIG. 1, is illustrated and described in detail in applicant's co-pending application referred to above. However, brief summary of such operating mechanism is set forth as follows:

Referring to FIG. 3, the back rest 18 is provided with a pair of similar extensions or projections 22 and 24, which, when the back rest 18 is in upright, substantially vertical position as shown in full lines in FIG. 1, depend from the lower edge thereof. The extension 22, at its extremity, is connected to one end of the conventional screw jack unit 26, shown in FIGS. 1, 3 and 4. Said screw jack unit comprises an exterior sleeve 26′ within which another sleeve 27 of smaller diameter telescopes and the outermost end of which is pivotally connected to extension 22 on back rest 18. The opposite end of sleeve 27 has a nut fixed thereto through which a screw of conventional type is threaded, said screw being rotated by the output shaft of gear unit 30 in accordance with well-known, conventional screw jack construction, whereby the screw is completely protected from leaking lubrication or otherwise exposing greasy mechanism. Gear unit 30, which is enclosed in a suitable housing is rigidly fixed to one end of the electric motor 32 which is mounted pivotally to the frame 16, which supports the seat 14. The screw of gear unit 30 is rotatable in opposite directions by the shaft 32′ of motor 32 for purposes of extending and retracting the sleeve 27 of screw jack unit 26 for moving the back rest unit 18 between its opposite limits of movement, such as those illustrated in exemplary manner in FIG. 1.

The other extension 24, which is carried by back rest 18, is connected at its extremity to one end of a connecting link 34, the opposite end of said link being connected to one end of a push rod 36, which is supported slidably by a pair of fixed guide bearings 38, which are rigidly connected to frame structure 16 for the seat 14. The opposite end of the push rod 36 is pivotally connected to one end of a link 40, the opposite end of which is pivotally connected to a suitable bracket 42 fixed to the under surface of the leg rest 20.

Figure 7:
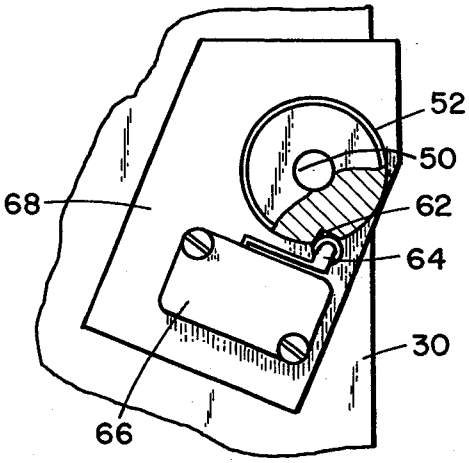
FIG. 7 is a fragmentary end view of part of the movement controlling mechanism shown in FIG. 6, as seen on the line 7—7 thereof, some of the mechanism being broken away to illustrate details, and the scale employed in said FIGURE being still larger than used in FIG. 6.
Figure 6:
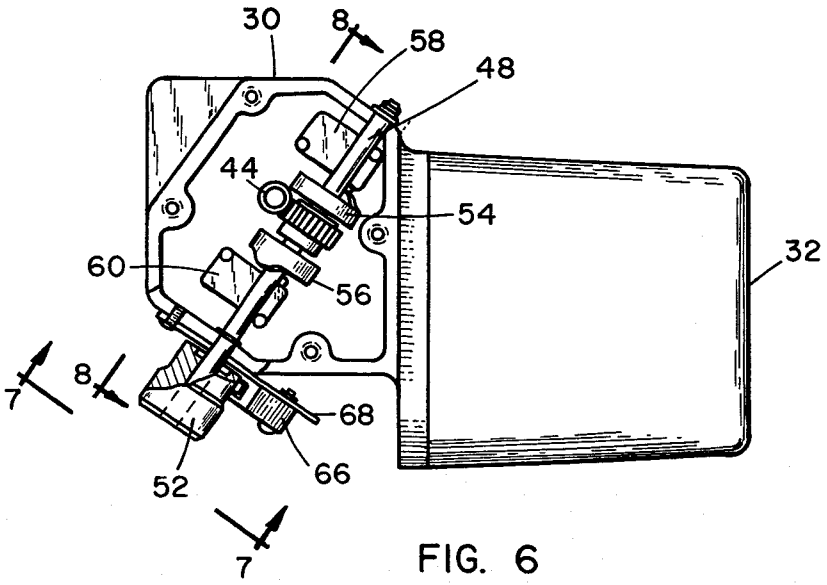
FIG. 6 is a bottom plan view, partly in section, showing details of movement controlling mechanism embodying the principles of the present invention and supported adjacent the motor utilized to move the back rest and leg rest between the various limits of movement thereof, said figure being illustrated on a much larger scale than employed in FIG. 3, in which the movement controlling mechanism is shown in bottom plan view.
Figure 8:
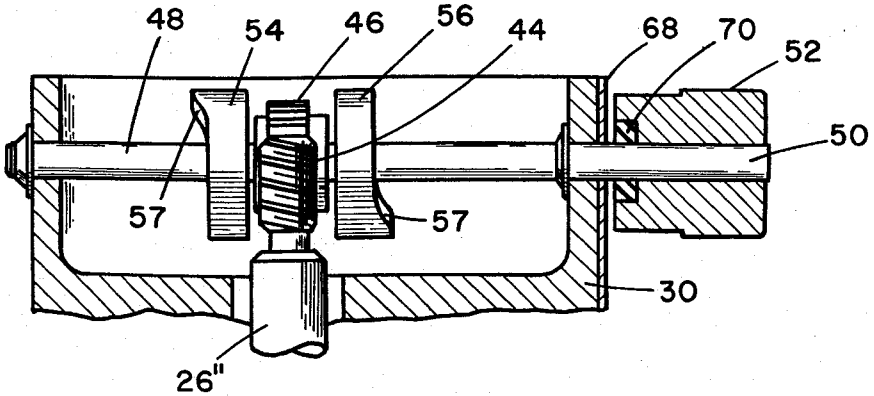
FIG. 8 is a fragmentary sectional view of the movement control mechanism otherwise illustrated in FIGS. 6 and 7, as seen along the axis of the shaft included in the control mechanism, the scale being similar to that used in FIG. 7.

From the foregoing, it will be seen, for example, that when the back rest 18 and leg rest 20 are in extended, substantially horizontal position, and the motor 32 is energized, the screw 26″ of screw jack unit 26, shown in FIG. 8, will be rotated in a direction to project the sleeve 27 outwardly from the tube 26′ and thereby cause the back rest 18 to be moved to upstanding position. Such movement also, by means of extension 24, which is connected to link 34, will move push rod 36 rearwardly with respect to seat 14, and thereby move the link 40 in a direction to cause the leg rest 20 to descend to its depending position, such as shown in full lines in FIG. 1. Reverse movement of motor 32 will correspondingly move the back rest 18 and leg rest 20 from their respective upright and depending positions to rearwardly and forwardly substantially horizontally extended position. All of the foregoing basic mechansim and the operation thereof is described and illustrated in detail in applicant's co-pending application. The present invention concerns primarily the movement controlling mechanism by which such operation of the chair is achieved and details of said control mechanism are described, as follows:

Attention is now directed to FIGS. 6–8. In FIG. 6, the motor 32 is illustrated in association with the reduction gear unit 30, the cover of which has been removed for purposes of disclosing the mechanism contained in one end thereof and preferably the end which is nearest one side of the chair seat and below the same, as shown best in FIG. 4. The screw 22″ of screw jack unit 26, at one end, has a small worm 44, projecting axially therefrom, as shown in FIG. 8, for driving engagement with a worm gear 46.

The worm gear 46 is fixed to a shaft 48, which extends at its opposite ends through opposing walls of the housing 30, as shown in FIGS. 6 and 8, said walls having suitable bearings therein to support shaft 48 therebetween and one end 50 of said shaft projects sufficiently beyond the adjacent wall of the gear unit 30 to receive a control and operator knob 52 which is readily accessible for adjustment beneath seat 14 and adjacent one side thereof as readily apparent from FIG. 3. Shaft 50 also supports a pair of switch actuators comprising face type cams 54 and 56, which may be secured to rotate therewith in any suitable manner, such as set screws or otherwise, not shown.

The pitch and relative diameters of the worm 44 and worm gear 46 are so selected that during the movement of the screw 26'' of screw jack unit 26, which is required to move the back rest 18, for example, between its upper and lower limits of movement, the shaft 50 will be rotated substantially only one revolution. This is in order that the operating lobes 57 on the outer faces of the cams 54 and 56 may actuate the plungers or leaves of Micro-switches 58 and 60.

The Micro-switches 58 and 60 actually are limit switches. They respectively function to stop the movement of the back rest and, correspondingly, if a leg rest is mounted upon the chair, it, too, will have the movement thereof stopped in the opposite limits of positioning provided in the chair assembly. In the event, however, it is desired to stop the back rest and/or leg intermediately between the limits of movement thereof, such as by operating another switch in the electrical circuit, to be described, it will be seen that the knob 52, at one section of its exterior, is provided with a cam notch 62, see FIG. 7, for purposes of actuating the switch actuator 64 of an additional switch 66, such as a Micro-switch, which is suitably mounted upon a support plate 68, which is suitably attached to one wall of the housing of reduction gear unit 30, as best shown in FIG. 6.

For purposes of disposing the cam notch 60 of knob 52 at a desired location to actuate the Micro-switch 66 and thereby stop the movement of the back rest 18, for example, intermediately between its opposite limits of movement, knob 52 is adjustable rotatably upon the end 50 of shaft 48 and any desired setting thereof upon the shaft is maintained by an insert 70, which is of a frictional nature, such as afforded by certain varieties of rubber compounds, synthetic resins, and otherwise. The frictional engagement between the inserts 70 and the end 50 of shaft 48 is sufficient that when the shaft 48 is being driven by the worm 44 and worm gear 46, the knob 52 will be carried thereby and thus, move the cam notch 62 therewith so as to actuate switch 66 when the back rest 18, for example, reaches the desired intermediate position referred to above. However, if the desired intermediate position is unsuited for a certain patient or operation, that position readily can be changed by moving the knob 52, and correspondingly, the cam notch 62, to a different position corresponding to the intermediate position of back rest 18 which is next desired. This is accomplished by rotating the knob 52 upon the end 50 of shaft 48, so as to overcome friction of the insert 70 momentarily, whereby when the new position of the knob upon the end 50 of the shaft is set, the knob will be maintained in that position upon the end 50 of the shaft until a further adjustment in the setting is desired. In the preferred operation of the chair, the adjustable program switch functions only while the back rest is moving rearward and downward. During return movement to upright position, the full movement occurs without interruption.

ELECTRICAL CIRCUIT

Figure 9:
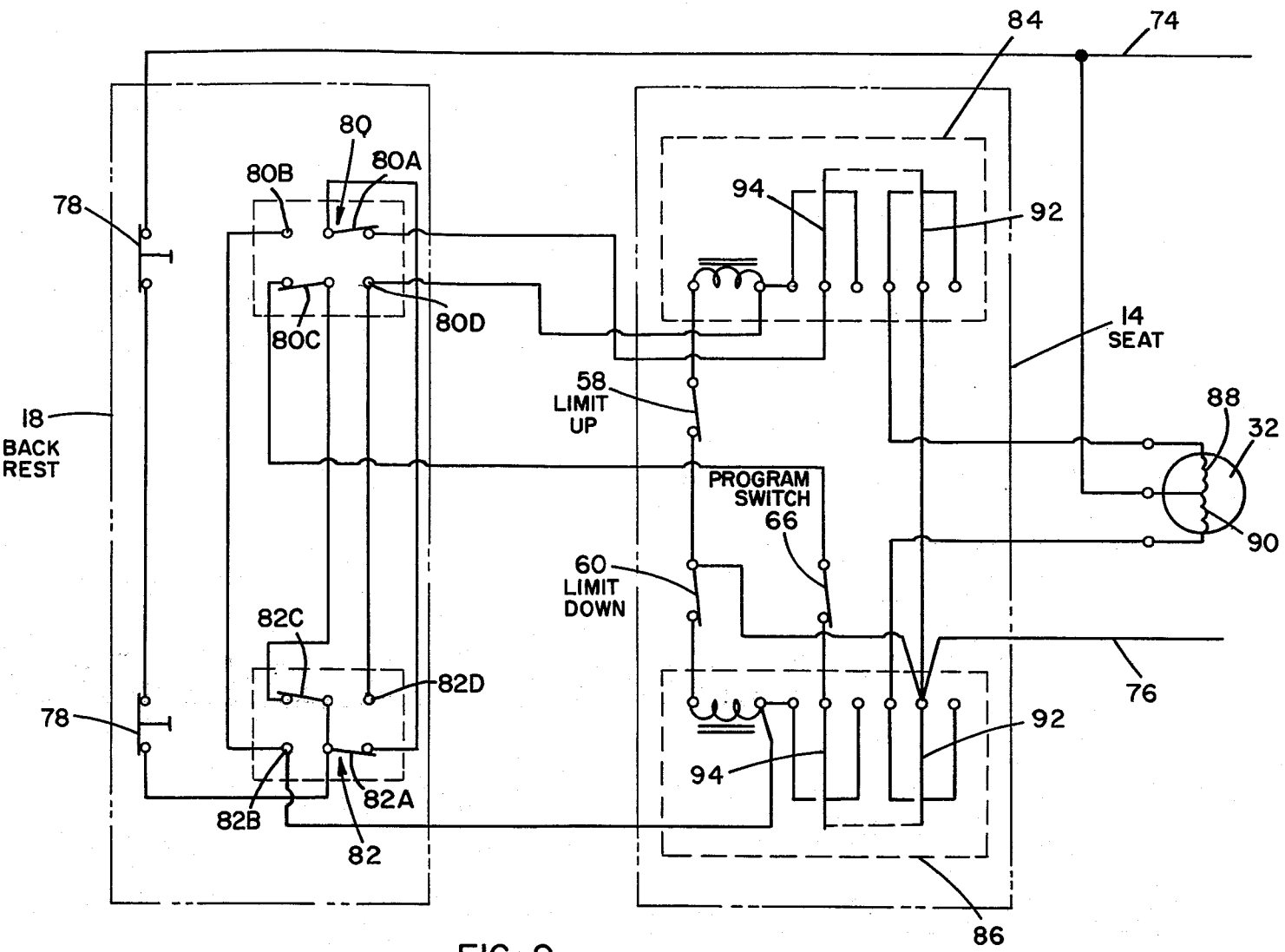
FIG. 9 is a wiring diagram of an electrical circuit of the preferred type employed in the movement control mechanism of the present invention.
Figure 10:
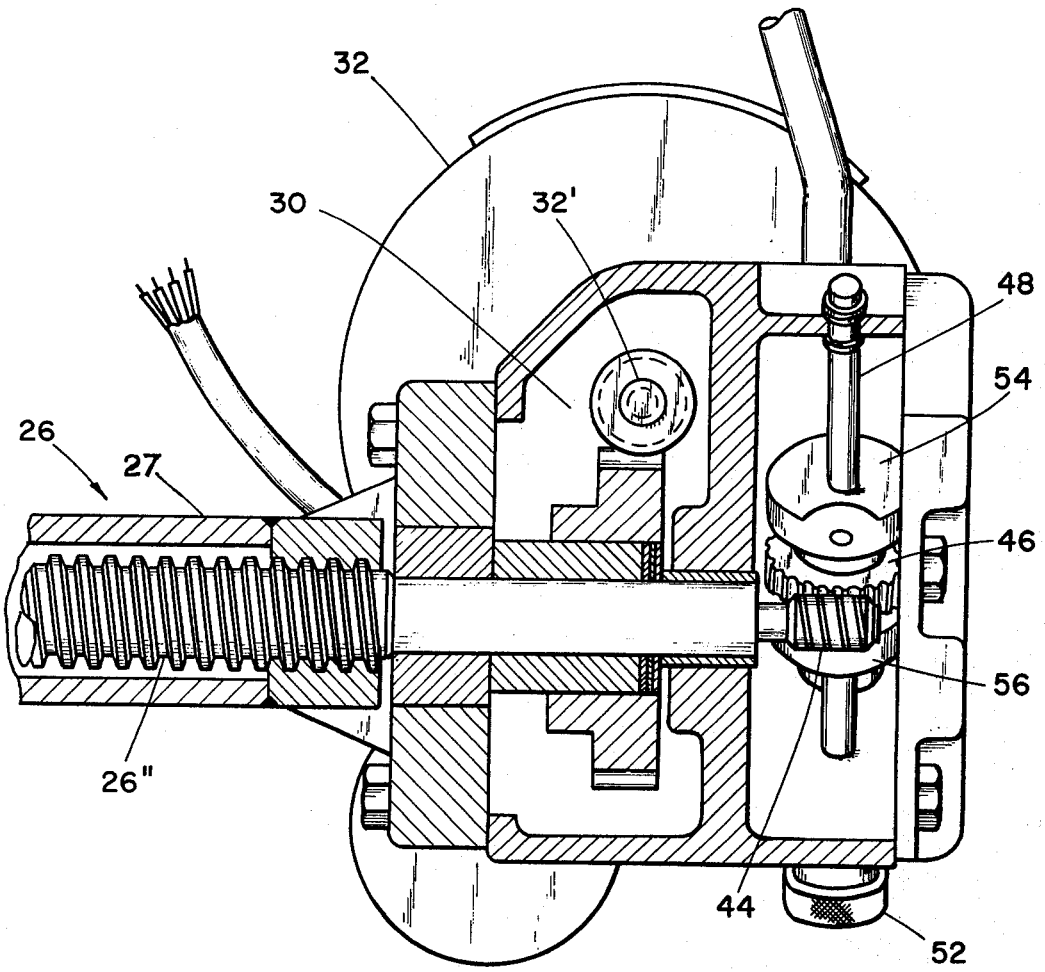
FIG. 10 is an enlarged sectional view of the gear reduction unit on the motor and the control mechanism operated thereby, as seen on the line 10—10 of FIG. 3.

Referring to FIG. 9, an electrical circuit is illustrated diagrammatically which is of a nature suited to embody the Micro-switches 58, 60 and 66 and connect the same to the motor 32. In accordance with customary structure, operating and control switch buttons of various kinds are mounted, preferably in a bank 72 thereof, which is supported for convenience of the operator at any suitable location, such as upon one side of the back rest 18, as shown in FIGS. 1 and 3–5. In view of the fact that the switch gear preferably is carried by the back rest 18, and other electrical units of the circuit preferably are carried by the seat 14, suitably on the under surface thereof, it will be seen in FIG. 9 that the back rest 18 has been outlined in phantom by a rectangular block and the seat 14 also has been outlined in phantom by a rectangular block. Preferably, there is a bank of switches on each side of the back rest 18, whereby said back rest and/or leg rest may be operated from either side of the chair, at the convenience of the dentist or attendant. Accordingly, in FIG. 9, it will be seen that in the rectangle denoting the back rest 18, a double set of switches is included in the circuit. Electric power from a suitable source is delivered to the chair through the feed line 74 and return line 76 of the circuit. A pair of momentary stop switches 78 wired normally closed respectively are included in the banks of switches 72 on opposite sides of back rest 18, as will be seen from the circuit in FIG. 9. Also, in designating additional switches in said circuit of FIG. 9, solid lines have been used to indicate switches in open position for the exemplary arrangement of the circuit illustrated in said figure, while broken lines have been used to indicate the switches in closed position.

At the left-hand side of FIG. 9, within the enclosure denoting back rest 18, a pair of rocker momentary type switches 80 and 82 that operate to either side of a center OFF position, are included in the circuit. One side of each of these switches, when closed, will arrange the circuit to drive the motor 32 in a direction to move the back rest 18 toward its lowermost position, while conversely, the other side of each switch, when closed, will control the circuit to operate the motor 32 in a direction to raise the back rest 18 toward its uppermost position. The Micro-limit switch 58, shown in FIG. 6, is included in the circuit in FIG. 9 and represents, for example, the means to limit the maximum upward movement of back rest 18. Normally, the switch is closed and when the maximum position is reached, the switch will be opened to disrupt the supply of current to motor 32.

Directly below switch 58 in FIG. 9, is Micro-limit switch 60, which also is shown in FIG. 6, and the switch normally is closed. It is disposed in the circuit in a manner to limit the maximum downward movement of back rest 18 to its substantially horizontal position, such as shown in full lines in FIG. 4, and when that position is reached, the switch 60 will be opened and disrupt the flow of current to motor 32.

The Micro-switch 66, herein shown in the circuit in FIG. 9, is considered a program switch, due to its adjustable position capability, and thereby is used to stop the movement of back rest 18 intermediately between its maximum limits of movement. Normally, the switch is closed, but when the actuator 64 thereof drops into cam notch 62 on knob 52, the switch will be opened and disrupt current to the motor 32, and thereby stop movement of the back rest 18. Thus, knob 52 is the program switch operator. In the preferred operation of the chair, the adjustable program switch functions only while the back rest is moving rearward and downward. During return movement to upright position, the full movement occurs without interruption.

The circuit in FIG. 9 also includes, in broken line rectangular outline, an up relay 84, and correspondingly, a down relay 86. Also, the motor 32 is a single phase motor and has an upwinding 88 and a downwinding 90.

To summarize and more fully explain the details and functions of switches 80 and 82 and relays 84 and 86, the following is submitted for purposes of clarity to supplement the foregoing description. To move the back rest toward its lowermost position, contact 80A or 82A of switch 80 or 82 is moved momentarily to contact terminal 80B or 82B, thus energizing the coil of relay 86 if limit switch 60 is closed. Contact 94 of relay 86 will keep the relay coil energized as long as both switches 60 and 66 remain closed, and contact 92 thereby supplies power to winding 90 of motor 32. When the chair back reaches a predetermined intermediate position or its lowest position, either program switch 66 or limit switch 60 will open, thus releasing the relay 86 and stopping the motor. Pushing the button, not shown, of either stop switch 78 will open the same and also interrupt the relay coil circuit and stop the motor. Similarly, to elevate the back toward the upright position, contact 80C or 82C of switch 80 or 82 is moved momentarily to contact terminal 80D or 82D and thus, energize the coil of relay 84, if limit switch 58 is closed, and thereby energize winding 88 of motor 32. Contact 94 of relay 84 will keep the relay coil energized until a stop switch 78 is opened or limit switch 58 opens at the uppermost position of the chair back and thus, stops further movement thereof.

In the circumstance where the back rest 18 has been moved to an intermediate position, such as by operation of the switch 66, and it is desired to have the back rest move, for example, to its lowermost position, this may be done by holding the rocker switch contact 80A of switch 80 or switch contact 82A of switch 82 respectively in engagement with the contact terminals 80B and 82B until the program switch 66 resets itself by closing, due to the continued operation of shaft 48 and knob 52 thereon. The up relay and down relay 84 and 86 each contain a motor contact 92, as well as a holding relay contact 94 which function in normal manner.

Basically, the switches 80 and 82 are the momentary type, meaning that it is merely necessary to press either the upside or downside of the switches 80 and 82 and then release the switch actuator. Such action energizes the coil of one of the relays, depending upon the switch which is actuated, and this will serve to maintain the circuit to themmotor complete so that the motor will continue to move the back rest until either the limit switch 58 or 60 is actuated at the end of the maximum travel of the back rest in the direction from which it started. If, in the meantime, the program switch 66 has been set to intervene in the movement of the back rest under the foregoing circumstances, prior to one or the other of the limit switches being opened, the program switch 66 will be opened by the operation of the knob 52 and will thereby stop the movement of the back rest at a desired pre-set position.

From the foregoing, it will be seen that a useful adjustable program type switch is included in the operating circuit of the motor which moves the back rest and leg rest relative to the seat, to augment the function of the limit switches and thereby permit automatic stopping of rearward and downward movement of the back rest intermediately of its opposite maximum limits of movement in opposite directions. The program switch is simple in construction and easy to install, in addition to contributing extensively to the convenience and versatility of the chair.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A chair including a seat, a back rest pivotally connected to said seat adjacent the rear edge thereof, power means comprising an electric motor mounted upon said chair, actuating means connected to said back rest and operable to move the same reversibly between normal substantially upright and rearwardly extending positions comprising opposite limits of movement thereof, reduction gear means connecting said actuating means to said motor for operation thereby, a worm and worm gear driven by said reduction gear means, and a shaft rotated by said worm gear for no more than one revolution during the full movement of said back rest between said substantially upright and rearwardly extending positions, in combination with an electrical control circuit for said motor comprising a plurality of limit switch means, said electric circuit being connected between said limit switch means and motor and a source of current and said switch means being operable to de-energize said motor when said back rest reaches either the normal upright or rearwardly extending limits of movement thereof, an adjustable program switch connected in said circuit, and an operator for said program switch adjustably carried by said shaft which is driven by said worm and worm gear and is operable during the actuation of said motor while moving said back rest toward said rearwardly extending limit position to de-energize said motor and thereby stop movement of said back rest prior to the same reaching said normal rearward limit of movement thereof.

2. The chair according to claim 1 in which the motor is mounted beneath said seat, and said operator for said program switch also being positioned for ready access beneath said seat.

3. The chair according to claim 1 in which said shaft has cams thereon respectively engageable with said limit switch means and thereby operable to interrupt the circuit to said motor and stop movement thereof when said back rest reaches said limits of movement thereof in opposite directions.

4. The chair according to claim 3 further including an actuator screw interconnected to said actuating means and motor and driven by said motor to move said back rest in opposite directions between said limits of movement thereof.

5. The chair according to claim 1 in which said operator for said adjustable program switch carried by said rotatable shaft is connected thereto adjustably and said operator being operable to actuate said switch and de-energize said motor at a desired position of said back rest prior to the same reaching one of its normal limits of movement as aforesaid.

6. The chair according to claim 5 in which said adjustable connection of said operator for said program switch upon said shaft comprises frictional means on said operator engageable frictionally with said shaft, said frictional engagement being adequate to maintain said cam in an adjusted position thereon after being adjusted relative to said shaft but said frictional engagement being capable of being overcome by manual movement of said cam relative to said shaft to establish a different desired position of said cam upon said shaft.

7. The chair according to claim 6 in which said program switch has an actuator and said operator for said switch comprises a knob having a cam surface engaged by said switch actuator to effect opening of said switch at a desired position of said back rest intermediate of the opposite limits of movement thereof.

* * * * *